United States Patent [19]

Kirsch

[11] Patent Number: 4,832,006

[45] Date of Patent: May 23, 1989

[54] MASSAGE APPARATUS

[76] Inventor: Sander Kirsch, Dreve de Linkebeek 65, B-1640 Rhode Saint Genese, Belgium

[21] Appl. No.: 67,739

[22] PCT Filed: Oct. 9, 1986

[86] PCT No.: PCT/BE86/00030

§ 371 Date: Jun. 4, 1987

§ 102(e) Date: Jun. 4, 1987

[87] PCT Pub. No.: WO87/02236

PCT Pub. Date: Apr. 23, 1987

[30] Foreign Application Priority Data

Oct. 11, 1985 [BE] Belgium ..... 125712

[51] Int. Cl.[4] ..... A61H 15/00

[52] U.S. Cl. ..... 128/57; 128/44

[58] Field of Search ..... 128/57, 56, 44, 62 R, 128/67, 24 R, 24.3

[56] References Cited

U.S. PATENT DOCUMENTS

| | | | |
|---|---|---|---|
| 1,246,203 | 11/1917 | Willman | 400/685 |
| 1,572,794 | 2/1926 | Hamilton | 128/57 |
| 1,722,866 | 7/1929 | Snyder | 128/57 |
| 2,072,959 | 3/1937 | Mulvaney et al. | 128/57 |
| 2,582,686 | 1/1952 | Fabio | 128/57 |
| 2,786,465 | 3/1957 | Moxley | 128/34 |
| 3,750,654 | 8/1973 | Shin | 128/57 |
| 3,756,224 | 9/1973 | Laymon | 128/57 |
| 4,010,743 | 3/1977 | Fitzsimons | 128/57 |
| 4,204,780 | 5/1980 | Elliott | 400/685 |
| 4,267,610 | 5/1981 | Blakeway | 128/57 |

FOREIGN PATENT DOCUMENTS

| | | | |
|---|---|---|---|
| 2135202 | 8/1984 | United Kingdom | 128/57 |

*Primary Examiner*—Edgar S. Burr
*Assistant Examiner*—Huong Q. Pham
*Attorney, Agent, or Firm*—Fishman, Dionne & Cantor

[57] ABSTRACT

An apparatus for physical fitness, reeducation and health improvement which is designed to apply a deep and systematic massage to the body through the use of rollers specifically adapted to the morphology of the different regions of the body. This apparatus has a support through which the optimal elevation for each roller can be selected. The rollers are composed of treatment wheels and spacers which enables their application to touch at the same time, the superficial and deep muscles, the tendons and ligaments of the joints concerned.

11 Claims, 4 Drawing Sheets

MASSAGE APPARATUS

BACKGROUND OF THE INVENTION

1. Field

This invention relates to a massage apparatus that is specifically designed to perform a deep systematic releasing massage on a functional region of the body which results in: an increase of blood and energy flow; a stimulation of the superficial and deep muscles; a slight stretching of the tendons, ligaments and articulations. Through the application of this apparatus the entire body will be rebalanced and the individual's well-being reestablished.

2. Prior Art

The benefits of massage on the health of man have been known for many centuries. Today as our civilization becomes more and more sedentary, massage treatments are being used to replace exercise, stimulate the vital organs and relieve suffering. Although there are many well trained masseurs and many excellent types of massage, there is still a great need to be able to give oneself a massage at an appropriate moment.

This necessity has become particularly acute in the case of our backs and spinal columns. Back pains have become so common today that this suffering is now known as "the disease of our century." To fulfill this need and owing to the difficulty to massage one's own back, many devices have been invented which are powered either by the individual or by an outside form of displacement. These devices can be grouped into five general classes:

Those that directly manipulation one vertebra at a time: U.S. Pat. No. 2,854,971.

Those that are a roller with a special profile for massaging the muscles or energy canals and have a "rolling pin" configuration: U.S. Pat. No. Des. 248,493; U.S. Pat. No. 3,750,654; U.S. Pat. No. 2,221,785; U.S. Pat. No. 896,484.

Those that have a series of rollers applied by hand: U.S. Pat. No. 3,756,224.

Those that use a single or a series of rollers in a support that is powered by an external force while the person lies still: U.S. Pat. No. 4,506,660; U.S. Pat. No. 4,191,177; U.S. Pat. No. 1,587,737.

Those that use a single or a series rollers in a support that the person moves across: U.S. Pat. No. 4,142,519; U.S. Pat. No. 2,619,957; U.S. Pat. No. 2,438,249.

In general each of the above mentioned devices should give a massage to the back and to some degree stimulate the sense of well-being. However for the most part these devices have a zone of effectiveness which is only superficial, that is the epidermis, the dermis, and adipose tissue and sometimes the superficial muscles are affected. Also the design of the rollers is the same for the entire back, or if it is specialized, it is only for a small area of the back, like the neck. Furthermore the amount of pressure applied to any one place cannot be precisely controlled by the individual treating himself.

Thus there remains a very real and substantial need for a massage apparatus, especially for the back: which can treat at the same time the superficial and deep levels of the muscles, tendons, ligaments and joints; which can be adapted to very different morphological forms that are found in the regions that it treats; which can have a precise control of the pressure on any one point that it treats. When these conditions are all fulfilled a highly specific deep massage can be achieved even without a practitioner.

SUMMARY OF THE PRESENT INVENTION

The above described needs have been met by the present invention. In the present invention each treatment roller has been designed to stimulate the circulation of blood and energy, to massage the superficial and the deep supporting muscles, to slightly stretch the tendons, ligaments and articulations concerned. Each treatment roller used in the present apparatus has been designed to treat a particular morphological region of the body. The support base of the present apparatus has been designed with different levels of elevation for each rollers so that the optimal penetration depth can be applied to the region being treated. In addition, because of the precise nature of this treatment, special instructions can be given to the individual as to the type of respiration and guided images that will facilitate the massage.

The present invention is composed of the following components:

A support base which gives stability to the apparatus during the massage, supports the different treatment rollers at their optimal elevation, and can be used to store the rollers when not in use.

The treatment rollers, specially adapted to the different morphological regions of the body. This adaptation is achieved through the use of treatment wheels which vary in respect to their profile, thickness, diameter and spacing.

The present invention can be used by the individual at home or at work, whenever he is in need of it. The apparatus presented here is designed to be used on the floor. But it could be used on a support at any point between the horizontal to the vertical position such as in an apparatus for physical re-education. The axis of the rollers are used perpendicular to the longitudinal axis of the individual using it.

Although the apparatus presented here is designed to be stationary with the individual moving himself across it, controlling his body weight for the pressure of the massage; it is possible in certain cases, such as paraplegia, to motorise the present apparatus for the movement and the pressure.

The present invention is designed to perform a total deep massage on a function system of the body. In the case presented here the functional system is the back with its vertebral column going from the head to the coccyx. With only slight modifications of the design presented here other fonctional system could be treated within the spirit of this invention. Examples of other such functional body systems are: the hips, legs and feet; the shoulders, arms and hands; the neck, thorax and abdomen.

DETAILED DESCRIPTION OF THE DRAWINGS

NOTE: Throughout this description the same number in parenthesis refers to the same functional element of the present invention.

Figure 1:
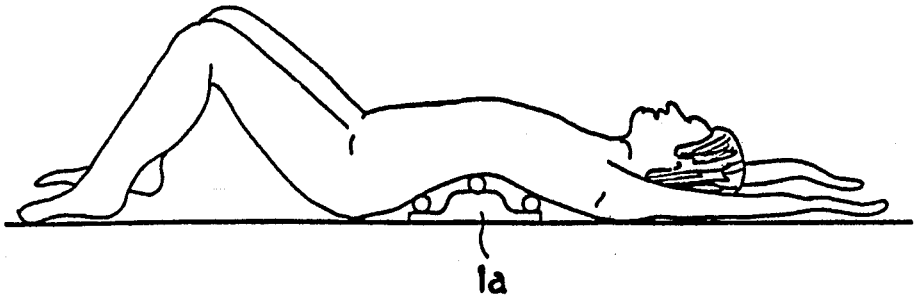
FIG. 1 presents a typical application of the present invention: a schematically represented treatment apparatus is in place with its support base on the floor and a person lying on it.

FIG. 1 shows how a person lies on the massage apparatus using the weight of the body part which touches the treatment roller in conjunction with his extremities to, at the same time move his body over the roller and modulate the depth of the massage.

Figure 2:
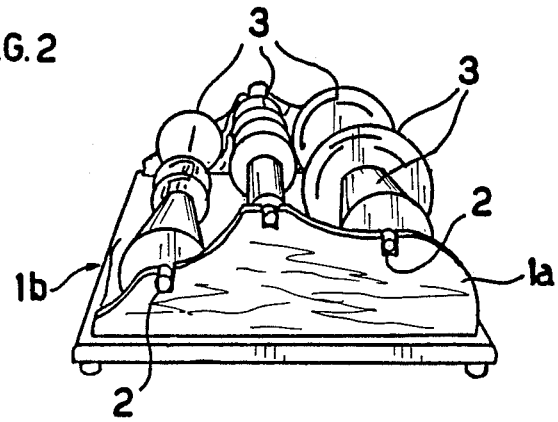
FIG. 2 presents a view in perspective of the treatment apparatus.
Figure 3:
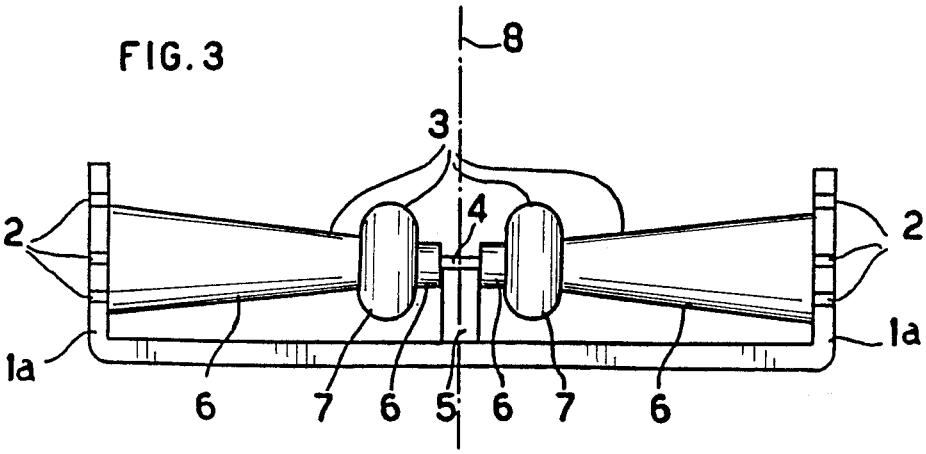
FIG. 3 presents a front elevation of the present invention showing the support base and one treatment roller with its component parts.

FIGS. 2 and 3 present the different components of the massage apparatus in relation to each other. There is a support base(1) consisting in two substantially vertical side members(1*a*) which are rigidly connected to one another by means of a connection part(1*b*). These side members(1*a*) are provided with a plurality of notches(2) disposed on said vertical side members(1*a*) at different heights. For each notch(2) on one side member (1*a*), there is a corresponding notch(2) on the opposite side member (1*a*) which is at substantially the same level so as to form a pair of notches. These notches(2) may vary in function of the region of the body being treated.

Each pair of notches(2) is adapted to receive the ends of a common axis(4). Three such axis are shown in the drawings but an apparatus according to this invention could also consist of two or more than three axis. Each axis is provided with a treatment roller(3), a central support(5), spacers(6) and treatment wheels(7) which vary in number, thickness, profile and diameter depending on the morphology of the region of the body being treated. With the exception of the central support(5), these elements are disposed symmetrically on either side of a longitudinal line(8) passing by the middle of the central support.

Figure 4:
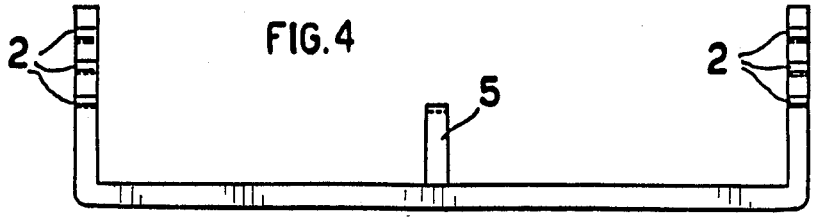
FIG. 4 presents a detailed front elevation of the support base showing the notches of different heights.
Figure 5:
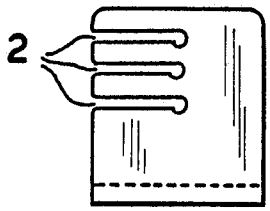
FIG. 5 is a side elevation of FIG. 4.

FIGS. 4 and 5 present the support base and illustrate one of the ways that notches(2) of different elevations can be manufactured into it. These notches can be cut into the side of the support base, arranged in a "stair-step" configuration, be adjustable through a screw thread arrangement or by any other manufacturing technique without departing from the spirit of the present invention.

Figure 6:
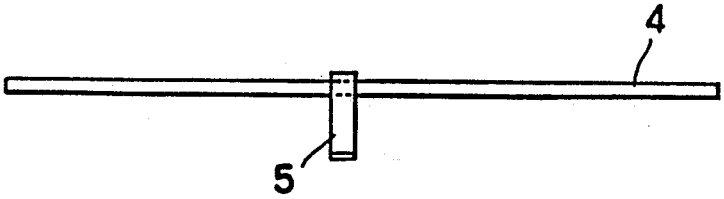
FIG. 6 presents a front elevation of an axis with its central support.

FIG. 6 presents a typical axis(4) on which a treatment roller(3) rotates. It has a central support(5) to prevent the axis from bending under the weight of a human body. In addition, the height of the central support(5) is calculated in function to the optimal elevation above the base necessary for the treatment roller.

As is clear from the drawings, central support 5 thus acts as an indexing support for matching a selected treatment roller 3 with a selected pair of notches 2. As is also clear from FIG. 6, central support 5 is permanently connected about axis 4 and extends substantially transversely from axis 4. The configuration of the central support many vary according to the manufacturing technique use without departing from the spirit of the present invention.

Figure 7:
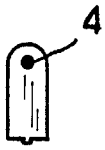
FIG. 7 is a side elevation of FIG. 6.

FIG. 7 presents for greater clarity a side elevation of FIG. 6.

Each treatment roller(3) consists of an axis on which it is held by the support and on which the treatment wheels(7) turn. The treatment wheels are designed in function of their thickness, profile, diameter and number to massage the critical muscles, tendon, ligaments and articulations in a specific body region. The spacers(6) between the different treatment wheels are designed to apply the treatment wheels at the correct location to stimulate blood and energy circulation. Each treatment roller(3) has an additional central support(5) so that it will not bend under the weight of a human body.

Figure 8:
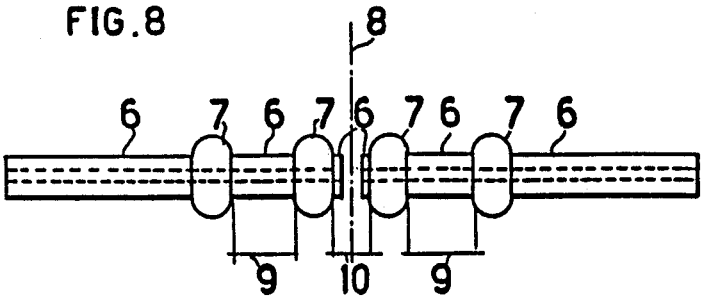
FIG. 8 presents a typical treatment roller for the head and the neck.

FIG. 8 presents a typical treatment roller with its spacers(6) and its treatment wheels(7). This roller is specially designed for the treatment of the head and the neck where (9) represents the optimal spacing for the treatment of the occipital, parietal, and temporal regions of the head. The optimal spacing for the treatment of the cervical spine is represented by (10).

Figure 9:
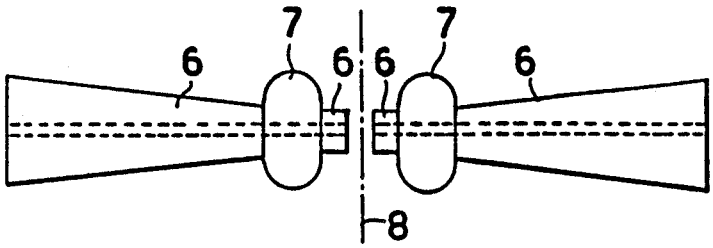
FIG. 9 presents a typical treatment roller for the dorsal and lumbar spine.

FIG. 9 presents another typical treatment roller with its spacers(6) and its treatment wheels(7). This roller is specially designed for the treatment of the dorsal and lumbar spine. The thickness, profile, diameter and spacing of the treatment wheels can be modified in function of the morphology of the individual being treated.

Figure 10:
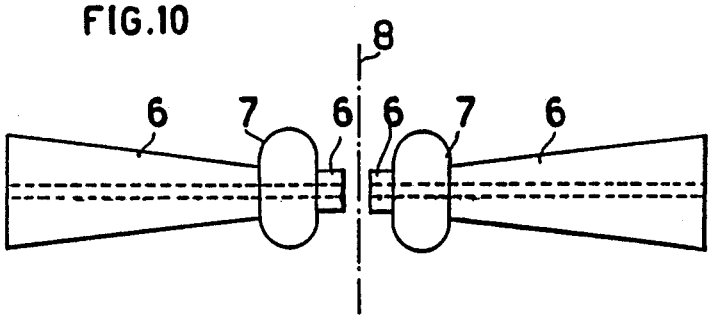
FIG. 10 presents a variant of FIG. 9 and is a typical treatment roller for the dorsal and lumbar spine for someone of small stature.

FIG. 10 presents another series of measurements for the same treatment roller but more adapted to the spine of an average women.

Figure 11:
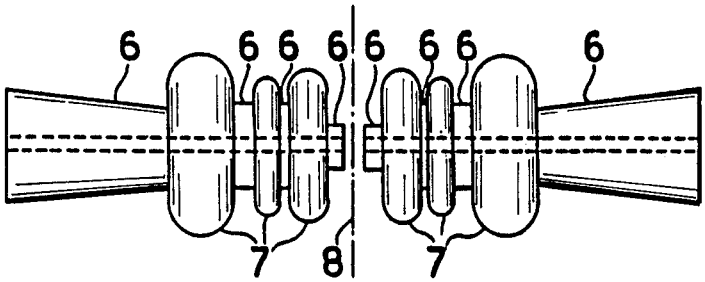
FIG. 11 presents a typical treatment roller for the pelvis.

FIG. 11 presents another typical treatment roller with its spacers(6) and its treatment wheels(7). This roller is specifically designed for the treatment of the pelvis. In the example shown here, there are three different treatment wheels symmetrically opposed to each side of the central support. The number of treatment wheels, their thickness, their profile and their diameter may vary in relation to the morphology of the individual being treated without changing the spirit of the present invention.

Figure 12:
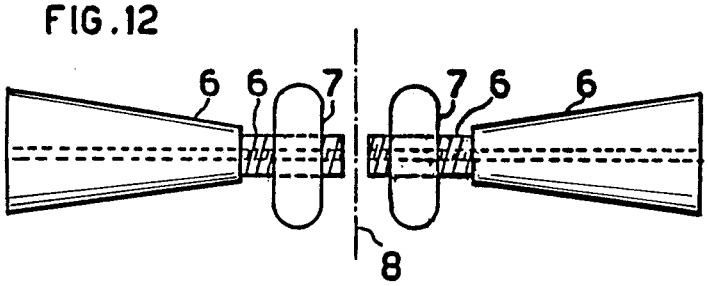
FIG. 12 presents a variant of the treatment roller shown in FIG. 10 by which screw adjustments can be used to modify the spacing of the treatment wheels in order to adjust for individual differences in stature.

FIG. 12 presents a variant of FIG. 10 by which the space between treatment wheels can be changed through use of a screw thread arrangement. The configuration of this variant is completely in the spirit of the present invention and shows an example of the different ways that the present invention can be assembled.

Figure 13:
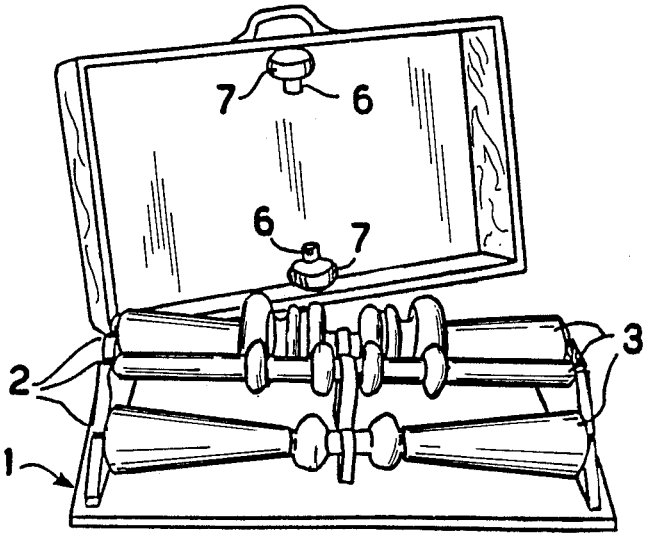
FIG. 13 presents a variant of the supporting base shown in FIGS. 2, 3 and 4 with its cover. In this variant a plurality of treatment rollers, their treatment wheels and their spacers can be stored or used at the same time.

FIG. 13 presents a variant of the support base(1) by which several different treatment rollers(3), in this case three can be stored and used at the same time, with each single roller at its optimal elevation. Here the notches(2) are vertical with respect to the support base. In addition the support base is also fitted with a cover(11), which renders the massage apparatus transportable and can store additional treatment wheels(7) and spacers(6). The configuration of this variant is completely in the spirit of the present invention and shows an example of another way that the present invention might be manufactured.

All of the treatment wheels(7) presented here may be modified with regard to their measurements to make them better adapted to the morphology of the individual being treated.

All of the spacers(6) presented here may be modified with regard to their measures to make them better adapted to the morphology of the individual being treated. They may be of any diameter, cylindrical, conic, concave, convex or other form deemed necessary for the optimal goals of the invention.

The configuration of the present invention utilizes a plurality of treatment rollers, on a plurality of axes, held at a plurality of elevations through the use of a specially designed support base. Through this configuration a highly effective and totally rebalancing massage can be obtained by anyone, even on normally inaccessible regions of the body. The apparatus of this invention is easy to use and economical to manufacture.

In relation to other massage apparatus:

the plurality of support axes makes it more convienient to use;

the plurality of treatment rollers makes it more polyvalent so tht one apparatus can be used to massage and rebalance a complete region of the body, like in this case the back and the vertebral column;

the plurality of treatment wheels and spacers allows it to, at the same time, stimulate the circulation of blood and energy and give a deep massage to muscles and tissues;

the plurality of elevations allow it to have the optimal penetration of the treatment wheels to flex and slightly stretch the ligaments of cohesion around each joint in the region being treated.

In addition, through the configuration of the plurality of treatment wheels and spacers of this invention, both male and female bodies can be treated with the same apparatus.

An adaptation of the configuration of this invention enables it to be used to treat other functional regions of the body, such as: the hips, legs and feet; shoulders, arms and hands; the neck, thorax and abdomen.

The apparatus of the present invention may be manufactured in a wide variety of material, such as: wood, plastic, rubber or metal. Any one material or combination of these materials is possible. The treatment rollers may be made in one piece or in multiple pieces. The treatment wheels may vary in their hardness depending on the type of stimulation desired. Different hardnesses may be used for different parts of the body in order to obtain optimal effectiveness of the present invention.

Whereas particular designs of the apparatus of the present invention have been described above for purposes of illustration, it will be evident to those skilled in the art that various modifications and alternative constructions can be made without departing from the full scope of the invention, as defined in the appended claims.

I claim:

1. An apparatus for massaging different morphological regions of the back comprising:

housing means, said housing means including first and second substantially vertical side members and a base rigidly interconnected between and being substantially transverse to said side members;

a plurality of notches on each of said side members, said notches each being located at a different distance above said base, said notches on said first side member being in registration with said notches on said second side member, each pair of said registered notches being adapted for supporting and positioning a treatment roller at a desired height above said base;

a plurality of treatment rollers removably mounted by said notches, each roller differing from the other in configuration so that each roller is adapted to treat a specific pre-selected morphological region of the back, each of said treatment rollers including a support axis;

an indexing central support permanently connected to said roller support axis for supporting said roller support axis, said central support extending substantially transversely from said support axis by a distance just sufficient to contact said base when said roller is supported in a registered pair of said notches so that said indexing central support determines the correct corresponding pair of registered notches to support and position the treatment roller to which it is permanently connected at a preselected height relative to said base so that said housing means will support and position different treatment rollers at different pre-selected heights and locations along said side members.

2. The apparatus of claim 1 wherein each of said treatment rollers comprise:

a selected arrangement of wheels and spacers arranged symmetrically with respect to said central support.

3. The apparatus of claim 2 including:

three treatment rollers, each roller differing from the other in the number and configuration of said wheels and spacers wherein each roller is adapted to treat a specific preselected morphological region.

4. The apparatus of claim 1 wherein:

each of said treatment rollers is of one piece construction.

5. The apparatus of claim 1 wherein:

said side members include corresponding upper surfaces having a plurality of heights whereby the heights of said notches will be differentiated.

6. The apparatus of claim 1 wherein:

said notches are located in said side member at differing heights whereby the heights of said notches will be differentiated.

7. The apparatus of claim 6 wherein:

said notches in said each member are superimposed over each other.

8. The apparatus of claim 1 including:

cover means for enclosing said housing means.

9. The apparatus of claim 8 including:

means in said cover means for storing treatment rollers, wheels or spacers.

10. The apparatus of claim 1 wherein:

each of said treatment rollers is comprised of a material having a preselected hardness commensurate with the type of stimulation required for the specific preselected morphological region of the back to be treated.

11. The apparatus of claim 2 wherein:

said preselected arrangement of wheels and spacers along said support axis corresponds to the needs of a specific pre-selected morphological region of the back.

* * * * *